US006563932B2

(12) United States Patent
Cork

(10) Patent No.: US 6,563,932 B2
(45) Date of Patent: May 13, 2003

(54) MAGNET SYSTEM FOR LOUDSPEAKERS

(75) Inventor: Paul Cork, Ipswich (GB)

(73) Assignee: KH Technology, Grand Cayman (KN)

( * ) Notice: Subject to any disclaimer, the term of this patent is extended or adjusted under 35 U.S.C. 154(b) by 0 days.

(21) Appl. No.: 09/847,692

(22) Filed: May 2, 2001

(65) Prior Publication Data

US 2002/0094107 A1 Jul. 18, 2002

(30) Foreign Application Priority Data

Jan. 16, 2001 (GB) ..... 0101132

(51) Int. Cl.[7] ..... H04R 25/00
(52) U.S. Cl. ..... 381/412
(58) Field of Search ..... 381/412, 421, 381/422, 419, 420, FOR 159, 161

(56) References Cited

U.S. PATENT DOCUMENTS

| | | | | |
|---|---|---|---|---|
| 4,868,882 A | | 9/1989 | Ziegenberg et al. | |
| 5,070,530 A | | 12/1991 | Grodinsky et al. | |
| 5,214,710 A | | 5/1993 | Ziegenberg et al. | |
| 5,548,657 A | | 8/1996 | Fincham | |
| 5,687,248 A | | 11/1997 | Yen et al. | |
| 5,740,265 A | | 4/1998 | Shirakawa | |
| 5,898,786 A | * | 4/1999 | Geisenberger | 381/416 |

FOREIGN PATENT DOCUMENTS

| | | |
|---|---|---|
| JP | 010270497 A | 4/1988 |
| JP | 070038996 A | 7/1993 |
| JP | 100322793 A | 5/1997 |

* cited by examiner

*Primary Examiner*—Sinh Tran
(74) *Attorney, Agent, or Firm*—Kenneth L. Sherman, Esq.; Sherman & Sherman

(57) ABSTRACT

A loudspeaker having a compact magnet system that produces an increased magnetic flux. A seat has an outer wall that retains an magnet therein such that a channel is defined therebetween. A plate is positioned on top of the first magnet such that an air gap is created between the plate and the wall. A second magnet is positioned over the plate and an aperture is created axially through the second magnet, the plate, and the first magnet. A yoke having a planar region and a protruding region extending therefrom is position over the second magnet such that the protruding region extends through the aperture and connects with the seat. A voice coil is connected to a diaphragm and is moveably suspended within the gap. Application of an electric current to the voice coils causes movement of the diaphragm due to the magnetic flux created within the gap and thereby produces sound waves.

20 Claims, 3 Drawing Sheets

MAGNET SYSTEM FOR LOUDSPEAKERS

FIELD OF THE INVENTION

This invention relates in general to magnet assemblies and magnets contained therein, and particularly to loudspeakers having a magnet system that achieves a greater flux within the air gap wherein the voice coil is suspended and reduces distortion.

BACKGROUND OF THE INVENTION

Conventional loud speakers utilize standard ferrous magnets in conjunction with a voice coil to control the speaker cone, dome, or other diaphragm. However, such magnets are relatively large and heavy and produce stray magnetic fields which require bulky shielding to contain leakage or increased distance therebetween and unnecessarily increase both the size and weight of the loud speaker. Furthermore, the larger components utilized in such transducers produces time displacement distortion and results in slow and inaccurate low frequency reproduction.

It is desirable in loud speakers to have a sub-compact assembly. It has been found that such a sub-compact design can be achieved by utilizing high energy magnets, such as magnets formed of neodymium-iron-boron in place of the standard ferrous magnets. However, even with the use of the neodymium-iron-boron magnets in a conventional topology, assemblies of the drive units are still bulky and complicated requiring numerous parts and numerous steps to assemble. In addition, the prior art magnet assemblies fail to provide a magnet assembly arrangement that is configured to produce a high degree of efficiency in the conversion of an electrical current into a mechanical movement in combination with the magnetic flux produced.

For example, U.S. Pat. No. 5,070,530 to Grodinsky et al. discloses a loudspeaker wherein large ceramic magnets are utilized. In order to decrease the undesirable eddy currents produced by such an arrangement, the ceramic magnet is slotted which may function as a stabilizing means for reducing distortion caused by the signal related magnetic fields induced into the magnet. Such ceramic magnets are by necessity larger in size and require bulkier shielding which may undesirably reintroduce the energy back into the voice coil and may interfere with the magnetic field, thereby leading to distortion.

U.S. Pat. No. 4,868,882 to Ziegenberg et al. discloses a loudspeaker wherein in an attempt to achieve less distortion in lower frequency sound production, an annular coil is provided with a core of amorphous metal. However, the extra materials used with the voice coil may result in the reduced ability to track the rapid changes in audio signals because of the frequency loss as a result of the flattened loudspeaker impedance.

U.S. Pat. No. 5,687,248 to Yen et al. discloses a cup shaped yoke having a first magnet and a second thinner magnet having a plate therebetween wherein similar poles of the magnets are in proximal relation to the plate. The second thinner magnet repels the first magnet and may reduce magnetic leakage. However, the top magnet may itself leak and providing a second plate thereon does not fully eliminate the same. In addition, the second plate on the second magnet does not contribute to the magnetic flux density in the air gap and does not contribute to the production of optimal sound.

U.S. Pat. No. 5,214,710 to Ziegenberg et al. discloses a first ring magnet and a second ring magnet having a plate therebetween whereby similar poles of the magnets are in proximal relation to each other. The second ring magnet repels the first magnet and may reduce magnetic leakage. However, the top magnet may itself leak and the absence of a second plate thereon will fail to prevent leakage. In addition, a second voice coil is included within inner void of the first and second ring magnets thus requiring further materials and a more complex construction.

U.S. Pat. No. 5,740,265 to Shirakawa discloses a transducer having a first and second disk magnets whereby dual magnetic gaps are formed between the outer diameter of the magnets and the same wall forming the yoke. Accordingly, the use of the same yoke to produce the two magnetic gaps may result in distortion as a result of the leakage of magnetic flux. In addition, the need for a longer coil bobbin adds to the size of the magnet structure and may result in lower quality sound production.

Therefore, there remains a long standing and continuing need for an advance in the art of loudspeakers that is simpler in both design and use, is more economical, compact, and efficient in its construction and use, and can quickly be assembled while eliminating the need for larger magnets.

SUMMARY OF THE INVENTION

Accordingly, it is a general object of the present invention to overcome the disadvantages of the prior art.

It is another object of the invention to provide a loudspeaker wherein the magnet assembly is reduced in size.

It is another object of the present invention to provide a loudspeaker wherein the assembly is reduced in weight.

It is another object of the present invention to provide a loudspeaker wherein the magnets and their housing is relatively compact.

It is yet another object of the present invention to provide a loudspeaker wherein the magnet structure produces a more efficient magnetic flux resulting in an increased motor strength and improved sound quality.

It is yet another object of the present invention to provide a loud speaker wherein the magnet structure produces less leakage of the magnetic flux.

It is yet another object of the present invention to provide a loudspeaker that provides lower distortion between the frequencies of 100 to 1000 Hz.

In keeping with the principles of the present invention, a unique loudspeaker utilizing a novel magnetic assembly is presented which overcomes the shortfall of the prior art. The magnet assembly has a preferably circular first seat that has a peripheral annular wall that extends perpendicularly therefrom. First seat is a magnet pot and is preferably constructed of low carbon steel. A first magnet that is preferably annular is received within the wall of first seat to form a uniform channel between and outer edge of the first magnet and the wall. A first aperture is axially defined within said first magnet. First magnet is attached to the floor of the first seat by any adhesive means that is known in the art such as, but not limited to, structural adhesives.

A plate that is preferably annular is positioned upon the first magnet. The plate also has an aperture axially defined therethrough and in substantial alignment with the aperture of the first magnet. An annular lip extends inwardly from a top portion of the wall such that an annular gap is created between the lip and the plate. An annular flange extends outwardly from the top portion of the wall and is adapted to receive a chassis thereon.

A second magnet that is preferably annular is positioned over the plate and also has an axially defined aperture therein. The second magnet is positioned such that the similar polarities of the first and second magnet are in proximal relation. In addition, the aperture defined through the second magnet, the plate, and the first magnet are substantially aligned.

A yoke having a planar region and a protruding region is positioned over the second magnet such that the protruding region extends through the aperture and connects to the seat. In such an arrangement, a first magnetic flux is created and maintained by the first magnet, plate, gap, annular lip, wall and the seat. In addition, a second magnetic flux is created and maintained by the second magnet, plate, gap, annular lip, wall, seat, the protruding region, and the planar region. The increased magnetic flux is directed into the gap wherein a voice coil is moveably suspended.

An annular chassis is positioned over the flange and the chassis moveably maintains a generally conical diaphragm thereon. The voice coil is attached to the conical diaphragm by a bobbin. As current is applied to the voice coil, the voice coil is forced to move within the gap due to the magnetic flux created by the magnets and other components. Accordingly, the conical diaphragm moves back and forth and thereby generates audio output.

Such stated objects and advantages of the invention are only examples and should not be construed as limiting this invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention.

In the drawings, wherein similar reference characters denote similar elements throughout the several views.

DETAILED DESCRIPTION OF THE INVENTION

Figure 1:
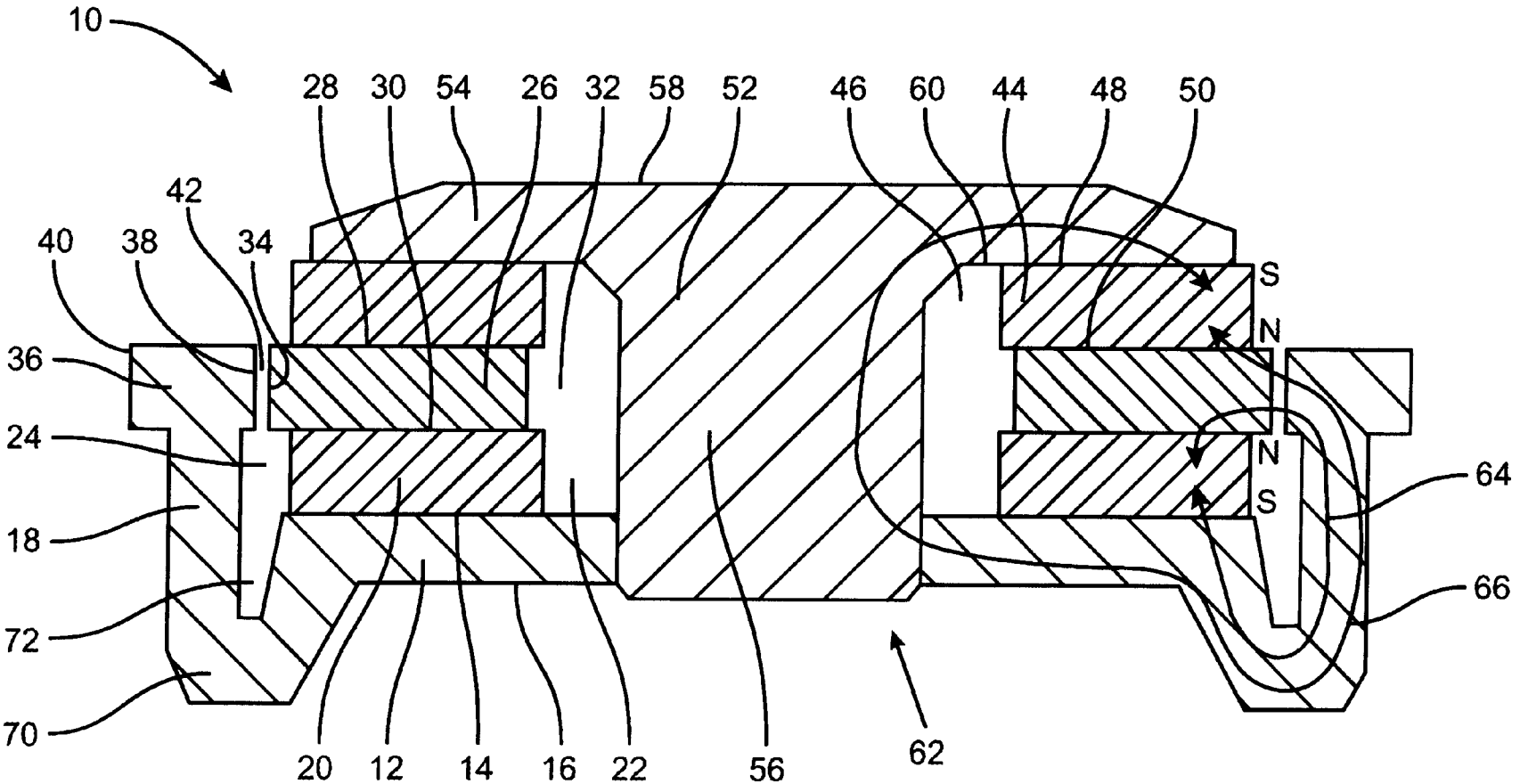
FIG. 1 is a cross sectional view of the magnet assembly used for driving a voice coil in one preferred embodiment of the present invention.
Figure 2:
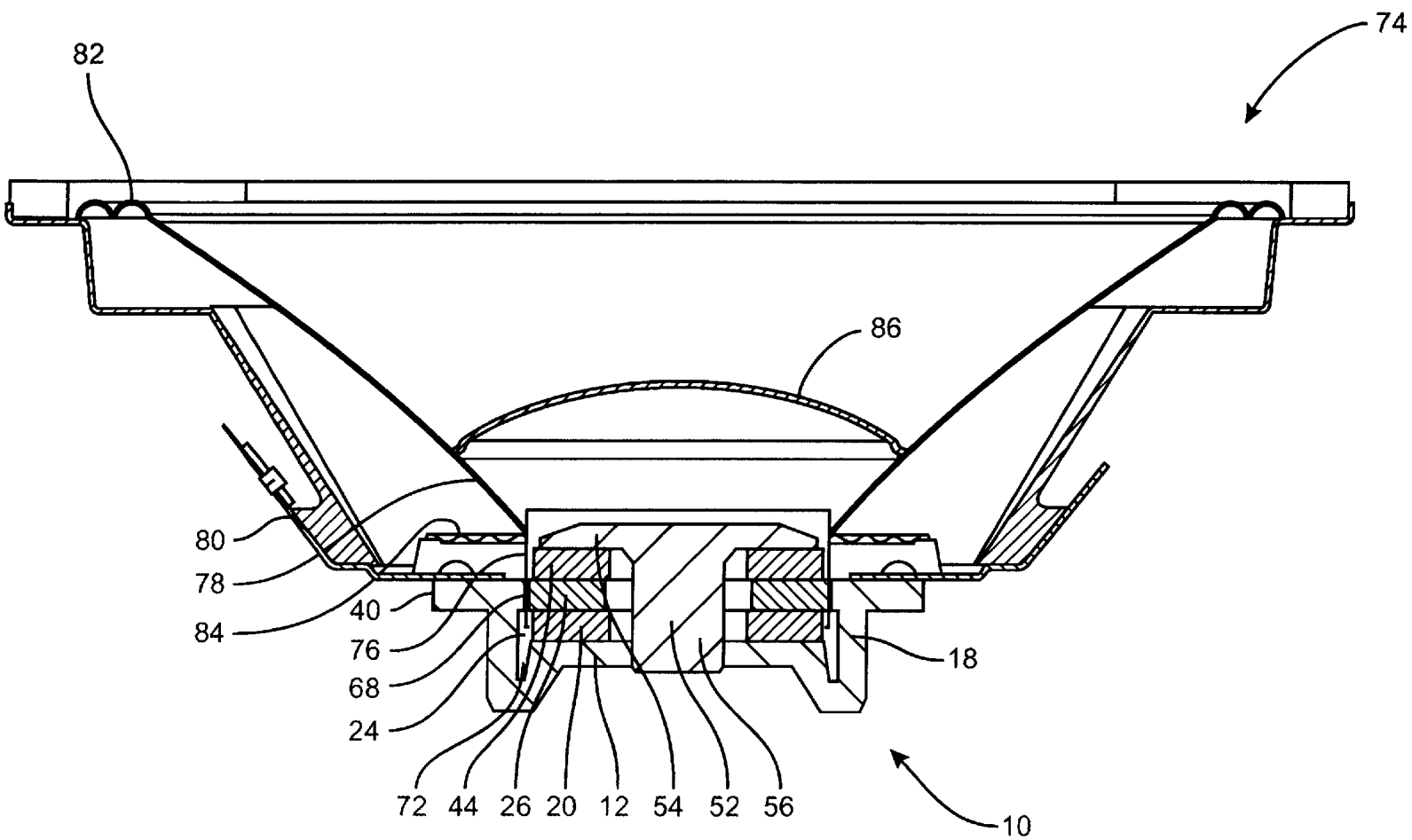
FIG. 2 is a cross-sectional schematic view which shows a first exemplary embodiment of a loudspeaker constructed according to the present invention.

Referring to FIGS. 1 and 2, therein is illustrated views of preferred embodiments of a magnet assembly 10 alone and as assembled with other components of a loudspeaker respectively. Magnet assembly 10 has a first seat 12 having a top surface 14 and a bottom surface 16. A wall 18 extends perpendicular to first seat 12 at an outer portion of thereof. First seat 12 is preferably circular and wall 18 is annular; however, it is to be understood that alternate embodiments may also be possible. First seat 12 may be constructed of a permeable but non coercive material, preferably a low carbon steel, but other material such as, but not limited to, pure iron, sintered iron, steel, cobalt steel, or any other high magnetic flux conducting material may be used.

A first magnet 20, that is preferably disk shaped having a first aperture 22 axially therein, is received within first seat 12 on top surface 14 thereof, such that a substantially uniform channel 24 is maintained between first magnet 20 and wall 18. First magnet 20 may be attached to top surface 14 of seat 12 by any attaching means that is known in the art such as, but not limited to, structural adhesives having high heat resistance.

A plate 26 having a top side 28 and a bottom side 30 is positioned upon first magnet 20 such that bottom side 30 contacts first magnet 20 at an end opposing top surface 14 of first seat 12. Plate 26 is preferably disk shaped and has a second aperture 32 axially therein such that second aperture 32 is substantially aligned with first aperture 22 of first magnet 20. Bottom side 30 of plate 26 may be attached to first magnet 20 by any attaching means that is known in the art such as, but not limited to, structural adhesives having high heat resistance. Plate 26 may be constructed of a permeable but non coercive material, preferably a low carbon steel, but other material such as, but not limited to, pure iron, sintered iron, steel, cobalt steel, or any other high magnetic flux conducting material may be used.

Plate 26 has an outer edge 34 that is substantially aligned with an upper portion 36 of wall 18. Upper portion 36 of wall 18 has an annular lip 38 that extends perpendicularly inward from wall 18 and is substantially parallel to top surface 14. An annular flange 40 extends outwardly from wall 18 and is substantially parallel to top surface 14. In a preferred embodiment, the height of annular lip 38 is substantially equal to the height of plate 26. In addition, plate 26 is positioned such that a substantially uniform gap 42 is defined between annular lip 38 and outer edge 34 of the plate 26.

A second magnet 44, that is preferably disk shaped, has a third aperture 46 axially defined therein. Second magnet 44 has an upper surface 48 and a lower surface 50 and is received upon plate 26 such that lower surface 50 of second magnet 44 is in proximal relation to top side 28 of plate 26. Second magnet 44 may be attached to top side 28 of plate 26 by any attaching means that is known in the art such as, but not limited to, structural adhesives having high heat resistance. In a preferred embodiment, first magnet 20 and second magnet 44 are high energy magnets such as, but not limited to, neodymium-iron-boron magnets.

A yoke 52 has a planar region 54 and a protruding region 56 that extends therefrom in a substantially perpendicular manner. Planar region 54 has a top face 58 and a bottom face 60 and protruding region 56 extends from bottom face 60. Protruding region 56 extends through third aperture 46, second aperture 32, and first aperture 22 and connects to seat 12. In such arrangement, bottom face 60 is proximal to upper surface 48 of second magnet 44 and may be attached thereto by use of heat resistant adhesives. In one preferred embodiment, protruding region 56 extends through seat 12 and out of bottom surface 16 thereof through a void 62 that is axially defined by seat 12. Void 62 is of sufficient size to intimately maintain protruding region 56 therein. In a preferred embodiment, heat resistant adhesives may be applied to the junction between protruding region 56 and seat 12 to securely maintain the same.

In such an arrangement, first magnet 20 and second magnet 44 are mounted such that similar poles are in proximal relation to one another. Second magnet 44 will now repel first magnet 20 such that magnetic energy is confined and directed towards gap 42. Furthermore, a first magnetic flux 64 is created by and travels through first magnet 20, plate 26, gap 42, annular lip 38, wall 18, seat 12, and returns to first magnet 20. In addition, a second magnetic flux 66 is crated by and travels through second magnet 44, plate 26, gap 42, annular lip 38, wall 18, seat 12, protruding region 56, planar region 54 and returns to second magnet 44. Accordingly, besides the second magnet 44 preventing magnetic leakage above the gap 42, second magnet 44 guides the same into gap 42 and increases the magnetic flux density therein. Moreover, planar region 54 functions as a magnetic shield and prevents magnetic leakage from second magnet 44 and reintroduces magnetic energy back to the same.

The increased magnetic flux is directed into gap 42 wherein a voice coil 68 is suspended. As a result of the magnetic flux within gap 42, voice coil 68 will be subjected to a force and will move in an upwards and downwards direction therein and within channel 24. In order to provide for greater movement within channel 24 and to eliminate spacers and the weight contributed thereto, plate 12 is maintained above a lower portion 70 of wall 18 such that a groove 72 is created therebetween to accommodate the movement of voice coil 68 therein.

Now referring specifically to FIG. 2, magnet assembly 10 can be incorporated into a loudspeaker 74. Voice coil 68 is wound on bobbin 76 in a fixed fashion and bobbin 76 is connected to a diaphragm 78 at a point distal to voice coil 68. A chassis 80 is mounted onto annular flange 40 and is adapted to receive diaphragm 78 at a point distal to bobbin 76. Diaphragm 78 is of generally frusto-conical form but may be adapted to any form that is known in the art. In order to attach diaphragm 78 to chassis 80, a flexible surround 82 is used therefor to allow movement of diaphragm 78 therein.

A suspension member 84, that is preferably annular and flexible in nature is secured between chassis 80 and bobbin 76 in order to ensure that bobbin 76 and voice coil 68 carried thereon are maintained concentric with and within gap 42 and out of physical contact with the surrounding elements during sound producing movements of diaphragm 78. The length of bobbin 76 may be extended or shortened as desired to control the optimal frequency of operation. As a result of the current flowing through voice coil 68, a driving force is generated that moves coil bobbin 76. In turn diaphragm 78 is caused to move back and forth axially. As diaphragm 78 moves forward, it compresses the air in front of it and as the dome moves backward it rarefies the air in front of it, and thus the desired audio output is produced by the numerous compressions and rarefactions.

In order to further reduce the weight of the loudspeaker 74, chassis 80 may be constructed of aluminum, magnesium, aluminum and magnesium alloy, plastic, enforced plastic, or any other suitable light weight yet rigid material. In order to prevent dust contamination from entering transducer 10, an element 86 traverses diaphragm 78 at a point proximal to bobbin 76. In a preferred embodiment, element 86 is dome shaped because its acoustic center may be readily located in close coincidence with that of diaphragm 78.

Figure 3:
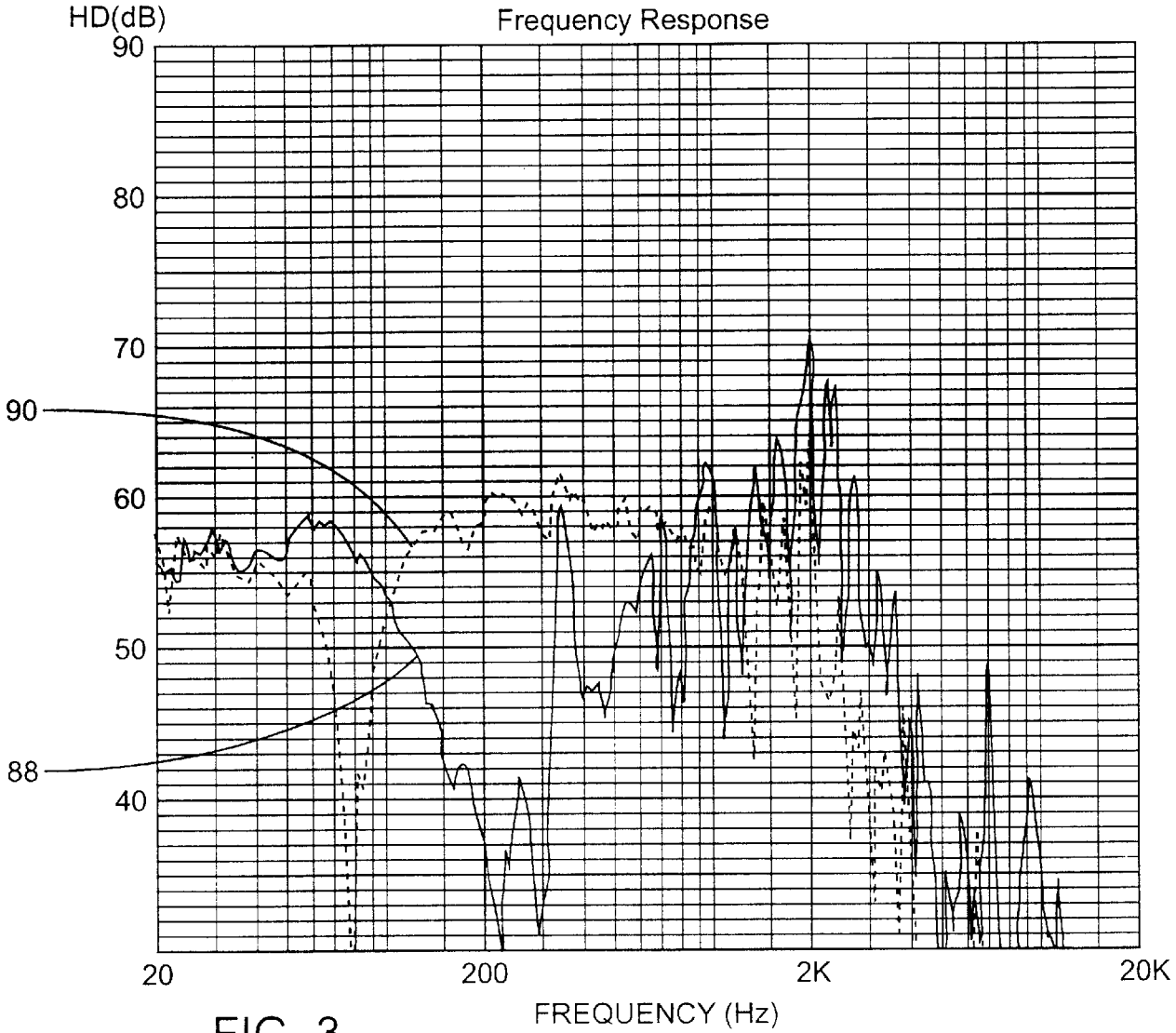
FIG. 3 is a graph showing the resulting distortion as a result of a corresponding frequency applied to a magnet assembly of the present invention (solid line) and to a ceramic assembly (dashed line) of the prior art.

FIG. 3 is a graph showing the level of second harmonic distortion as a result of a corresponding frequency. A solid line 88 illustrates the distortion curve created by magnet assembly 10 when compared to a dashed line 90 representation of the distortion curve of a ceramic magnet assembly of equal size when measured by a swept sine wave input signal. As can be discerned therefrom, the magnetic assembly of the present invention produces lower levels of distortion between a frequency of 100 to 1000 Hz, and as a result, produces a greater level of sound quality.

It can be appreciated that as a result of the reduced distortion of the present magnetic assembly and the greater magnetic flux produced within the air gap, the assembly of the present invention is smaller and lighter than those in the prior art. In a four inch voice coil incorporating the assembly of the present invention, the magnet assembly has a diameter of 122 mm and the structure weighs 3.4 Kg, whereas a ceramic assembly for a four inch voice coil has a magnet with an outer diameter of 220 mm and a weight of 8.8 Kg. However, despite the smaller and lighter assembly of the present invention, both assemblies produce a substantially equivalent magnetic flux within the air gap.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A magnetic assembly for use in transducers, comprising:

a seat having a top surface and a bottom surface;

an outer wall extending from said top surface in a substantially perpendicular direction thereto;

a first magnet having a first aperture axially defined therein being positioned upon said top surface of said seat such that a channel is defined between an outer periphery of said first magnet and said outer wall;

a plate having a second aperture axially defined therein being positioned upon said first magnet such that said first aperture and said second aperture are aligned;

a gap being defined between said plate and said outer wall;

a second magnet having a third aperture axially defined therein being positioned upon said plate such that said third aperture, said second aperture, and said first aperture are substantially aligned;

a yoke being positioned upon said second magnet and having a protruding member extending through said first aperture, said second aperture, and said third aperture and connecting to said seat.

2. The assembly of claim 1, wherein said first and second magnets and said plate are annular.

3. The assembly of claim 1, wherein said first and second magnets are constructed of neodymium iron boron.

4. The assembly of claim 1, wherein said first magnet and said second magnet are arranged such that similar polarities of each magnet are in proximal relation to one another.

5. The assembly of claim 1, wherein a first magnetic flux within said gap is produced and maintained by said first magnet, said plate, said wall, and said seat.

6. The assembly of claim 1, wherein a second magnetic flux within said gap is produced and maintained by said second magnet, said plate, said wall, said seat, and said yoke.

7. The assembly of claim 1, wherein a lip extends inwardly from an upper portion of said wall and is of substantially equal height as said plate such that said gap is narrower than said channel.

8. The assembly of claim 7, wherein a first magnetic flux within said gap is produced and maintained by said first magnet, said plate, said lip, said wall, and said seat.

9. The assembly of claim 7, wherein a second magnetic flux within said gap is produced and maintained by said second magnet, said plate, said lip, said wall, said seat, and said yoke.

10. The assembly of claim 1, wherein a void is defined substantially axially through said seat and is adapted to receive said protruding region of said yoke therein in an intimate relation.

11. The assembly of claim 10, wherein a structural adhesive securely attaches said protruding region to said seat.

12. The assembly of claim 1, wherein said seat, said plate, and said yoke are constructed of a material selected from a group consisting of low carbon steel, steel, pure iron, sintered iron, and cobalt steel.

13. The assembly of claim 1, wherein a heat resistant adhesive connects said seat, said first magnet, said plate, said second magnet and said yoke respectively.

14. The assembly of claim 1, wherein said wall has a lower portion that extends beyond said seat such that a groove is formed between said wall and said seat.

15. A magnetic assembly for a transducer producing an increased magnetic flux, comprising:

a seat having a top surface and a bottom surface and axially defining a void therein;

an annular outer wall extending from said seat in a substantially perpendicular direction thereto;

an annular lip extending inwardly from said wall at a point distal to said seat;

an annular first magnet having a first aperture axially defined therein being positioned upon said top surface of said seat such that a channel is defined between an outer periphery of said first magnet and said outer wall;

an annular plate having a second aperture axially defined therein being positioned upon said first magnet such that said first aperture and said second aperture are aligned;

a gap being defined between said plate and said annular lip;

an annular second magnet having a third aperture axially defined therein being positioned upon said plate such that said third aperture, said second aperture, and said first aperture are substantially aligned;

a yoke being positioned upon said second magnet and having a planar region and a protruding region extending therefrom in a substantially perpendicular manner such that said protruding region passes through said first aperture, said second aperture, and said third aperture and is intimately maintained within said void defined by said seat.

16. The assembly of claim 15, wherein a first magnetic flux within said gap is produced and maintained by said first magnet, said plate, said lip, said wall, and said seat.

17. The assembly of claim 15, wherein a second magnetic flux within said gap is produced and maintained by said second magnet, said plate, said lip, said wall, said seat, said protruding region, and said planar region of said yoke.

18. The assembly of claim 15, wherein a first magnetic flux within said gap is produced and maintained by said first magnet, said plate, said lip, said wall, and said seat; and a second magnetic flux within said gap is produced and maintained by said second magnet, said plate, said lip, said wall, said seat, said protruding region, and said planar region of said yoke.

19. The assembly of claim 15, wherein similar polarities of said first magnet and said second magnet are positioned in proximal relations.

20. A loudspeaker assembly having decreased distortion and an increased magnetic flux, comprising:

a seat having a top surface and a bottom surface and axially defining a void therein;

an annular outer wall extending from said seat in a substantially perpendicular direction thereto;

an annular lip extending inwardly from said wall at a point distal to said seat;

an annular first magnet having a first aperture axially defined therein being positioned upon said top surface of said seat such that a channel is defined between an outer periphery of said first magnet and said outer wall;

an annular plate having a second aperture axially defined therein being positioned upon said first magnet such that said first aperture and said second aperture are aligned;

a gap being defined between said plate and said annular lip;

an annular second magnet having a third aperture axially defined therein being positioned upon said plate such that said third aperture, said second aperture, and said first aperture are substantially aligned;

a yoke being positioned upon said second magnet and having a planar region and a protruding region extending therefrom in a substantially perpendicular manner such that said protruding region passes through said first aperture, said second aperture, and said third aperture and is intimately maintained within said void defined by said seat;

a bobbin having a voice coil maintained thereon being moveably suspended within said gap;

a diaphragm connected to said bobbin distal to said voice coil;

a chassis connecting to said wall and flexibly attaching to said diaphragm; and a suspension member attaching said bobbin to said chassis such that it is moveably suspended within said gap.

* * * * *